US006619819B2

(12) United States Patent
Stowell et al.

(10) Patent No.: US 6,619,819 B2
(45) Date of Patent: Sep. 16, 2003

(54) LAMP ASSEMBLY

(75) Inventors: Quinton Stowell, Berkshire (GB); Patrick Keogh, Berkshire (GB)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/085,195

(22) Filed: Feb. 27, 2002

(65) Prior Publication Data

US 2002/0118541 A1 Aug. 29, 2002

(30) Foreign Application Priority Data

Feb. 27, 2001 (GB) ..... 0104845

(51) Int. Cl.[7] ..... F21V 29/00

(52) U.S. Cl. ..... 362/294; 362/373; 362/345; 362/297; 362/218

(58) Field of Search ..... 362/294, 373, 362/345, 218, 297, 300, 573, 96

(56) References Cited

U.S. PATENT DOCUMENTS

| | | | | |
|---|---|---|---|---|
| 3,819,929 A | | 6/1974 | Newman | 362/228 |
| 4,000,407 A | * | 12/1976 | Keller et al. | 362/218 |
| 5,094,010 A | * | 3/1992 | Jacobi et al. | 34/278 |
| 5,321,595 A | * | 6/1994 | Jacobi et al. | 362/373 |
| 5,722,761 A | * | 3/1998 | Knight | 362/96 |
| 6,457,846 B2 | * | 10/2002 | Cook et al. | 362/321 |

FOREIGN PATENT DOCUMENTS

| | | | |
|---|---|---|---|
| EP | 0900977 | 3/1999 | F21S/5/00 |
| FR | 2334966 | 7/1977 | G02B/5/10 |
| GB | 1554253 | 10/1979 | F21S/2/00 |
| GB | 2024393 | 1/1980 | A61N/5/06 |
| GB | 2284469 | 6/1995 | F21S/3/00 |
| GB | 2315850 | 2/1998 | F21V/7/12 |
| GB | 2336895 | 11/1999 | F21V/7/00 |
| JP | 58061831 | 4/1983 | B01J/19/12 |

* cited by examiner

*Primary Examiner*—Sandra O'Shea
*Assistant Examiner*—Ali Alaui
(74) *Attorney, Agent, or Firm*—Wood, Herron & Evans, L.L.P.

(57) ABSTRACT

A lamp assembly comprising an elongate source of radiation, a reflector with an elongate reflective surface partly surrounding the source and having an opening for emission of radiation down towards a substrate for curing a coating thereon. The reflective surface has a generally concave profile and the source is located near the base of the concavity. The reflector includes two reflector elements each having a shaped surface which combines with the other when the elements are held in a first relative position to form a cavity in which the source is located and on the surface of which the reflective surface is provided. The source is mounted to be movable with one element to a second position relative the other element in which the source is located in a user accessible position.

14 Claims, 4 Drawing Sheets

LAMP ASSEMBLY

The present application claims the priority of British patent application No. 0104845,3, filed on Feb. 27, 2001. The disclosure of this prior related application is hereby fully incorporated by reference herein.

FIELD OF THE INVENTION

This invention relates to lamp assemblies, and more particularly to lamp assemblies for use in the printing and coating industry for the fast curing of inks and the like on a large variety of substrate materials.

BACKGROUND OF THE INVENTION

It is well known to cure inks on a substrate by application of ultra-violet radiation from one or more medium-pressure ultra-violet lamps. It is also well known to provide each lamp in an assembly with a reflector which includes a reflective surface partly surrounding the lamp for reflecting radiation therefrom onto the substrate. The reflective surface has a concave profile which is commonly elliptical or parabolic, the lamp being mounted on the symmetrical centerline of the profile and adjacent the apex.

The reflector increases the intensity of the radiation received by the curable material. The penetration of the radiation into the material is an important factor in curing and, whilst penetration varies with different colors and materials, the higher the intensity the better the penetration.

One problem with known arrangements is that the angular spread of the radiation output from the reflector may be quite high with the consequence that radiation is received across a wide band of the substrate at varying levels of intensity. The highest intensity locations will depend on the degree of focusing provided in the assembly but there may be regions where the level of intensity is low. The large angular spread means that the substrate has to be moved more slowly than is desirable if the intensity of radiation is to be sufficiently high.

Another problem which arises with known arrangements is that part of the radiation is reflected back onto the lamp itself, which reduces the amount of radiation energy available for curing and leads to heating of the lamp which can adversely affect lamp operation and increase the already large amount of heat given off by the assembly which may cause warping and distortion of the coating and/or the substrate.

This problem has been recognized in French Patent 2334966 which describes a reflector in the form of two half-shells, each of which is pivotal about a longitudinal axis within the cavity to the sides of the symmetrical centerline thereof. The French Patent proposes deforming the top region of the reflector to give it, externally, a generally concave shape across the width of the lamp by bending the top edge of each half shell down towards the lamp.

The apparatus disclosed in French Patent 2334966 has disadvantages as a result of its basic form in that a complicated system will be necessary to achieve the desired pivoting action and space has to be provided to accommodate the half-shell pivoting which is inconsistent with the current industry desire for smaller curing assemblies. Cooling of the half-shells will be difficult, again because of the need to accommodate the pivoting action. Problems will also arise as a result of the solution proposed in the French Patent to the problem of lamp self-heating. The distortion of the reflector towards the lamp will lead to excessive heating of the distorted portion and will make cooling of the adjacent region of the lamp much more difficult.

The desire in the industry for smaller curing assemblies mentioned above gives rise to a problem in that decreasing the width of the assembly to enable it to occupy a smaller space in a line can have the result of increasing the angular spread of the emitted radiation. This in turn gives rise to the problems already discussed above.

The efficient and effective cooling of lamp assemblies has been a constant problem which has become even more important as ever increasing lamp powers have been employed to give faster curing such that substrate speeds can be increased. For example, at the date of the French Patent, 1975, lamp powers were only in the region of 250 Watts per inch (100 Watts per cm). Lamp powers of 200–400 Watts per inch (80–160 Watts per cm) are now common and lamps of even higher powers, 500–600 Watts per inch (200–240 Watts per cm) are increasingly being used. Furthermore, the advantages of UV curing, including cleanness and quality, have led to a demand for curing systems capable of operating with a wide variety of substrates, including substrates which are very vulnerable to heat damage.

Earlier assemblies were generally cooled by air alone. In the first air-cooled systems, air was extracted from within the reflector through one or more openings provided above the lamp to draw out the heat. In later systems, cooling air was blown into the assembly and onto the lamp, again through openings located adjacent the lamp. A problem with air cooling is that the blowers required increase the size of the assembly making it difficult to install between the stands of a multi-stand press.

This, and the increasing cooling requirements due to higher lamp powers, led to the use of water cooling alone or in conjunction with air cooling. The cooling water is fed through tubes attached to or integrally formed in the reflector. In addition, a number of designs have been proposed with filters comprising one or two tubes of quartz provided between the lamp and the substrate through which liquid is passed, typically de-ionized water. As well as contributing to the cooling, the filters have the primary effect of filtering infra-red radiation, which tends to heat the substrate, and focusing the light from the lamp onto the substrate. The liquid coolant is circulated to and from all the tubes through cooling or refrigerating means.

As lamp powers increase, ever more efficient and effective cooling systems are required to keep temperatures within acceptable limits, not only to prevent damage to the substrate, but also to prevent harm to adjacent equipment and to operators of the printing system.

One known design of lamp assembly has a reflector in the form of a block with a cavity on the surface of which the reflective surface is provided. The reflective surface may be formed by polishing the cavity surface or a specific reflector member can be attached thereto. In either case it is known to provide coatings on the reflective surface of heat-absorbing material.

British Patent No. 2315850 discloses a lamp assembly in which the reflector block is formed in two parts. The reflector surface is provided by two reflector plates, each of which is fitted between a flange extending into the cavity and a clamp attached to an end of the reflector block half by tightenable fastening means.

It is known to water cool reflector blocks by forming one or more passages therein for flow of cooling water. With two-part blocks, this requires water inlet and outlet pipes for both parts, that is, four pipes in total. The need to accommodate these pipes and to maintain the integrity of the water seals between them and the block passages makes the assembly as a whole unwieldy and furthermore makes it difficult to move one block part relative the other.

A further problem with block form reflectors, and indeed other reflectors, is that the radiation source is often relatively inaccessible and so it takes a significant time to change the source. This means that there may be significant down time when the lamp or other type of radiation source has to be changed.

SUMMARY OF THE INVENTION

It is a general object of the present invention to provide a lamp assembly which overcomes one or more of the problems associated with known assemblies, as discussed above. It is a more particular object to provide a lamp assembly which can be of small size but still provide high intensity radiation by reducing the angular spread of the radiation. It is a further particular object to provide a lamp assembly with a water cooling system, which has minimal equipment and is easier to accommodate in the assembly. It is a still further particular object to provide a lamp assembly in which the lamp or other radiation source can be readily accessed and so easily changed.

A lamp assembly in accordance with a first aspect of the invention comprises an elongate source of radiation, a reflector with an elongate reflective surface partly surrounding the source and having an opening for emission of radiation down towards a substrate for curing a coating thereon, the reflector comprising two body members each having a shaped surface which combines with the other when the body members are held in a first relative position to form a cavity in which the source is located and on the surface of which the reflective surface is provided, at least one passage through each body member for cooling water flow, and a tube for cooling water flow located in the vicinity of the emission opening wherein the or a passage in one body member is connected to the tube which is connected to the or a passage in the other body member.

The advantage of this is that only one water inlet tube and one water outlet tube is required, the outlet water from one body member being inlet to the other body member via the cooling tube. Thus the cooling tube is used as part of a flow path between the two body members and the number of water tubes is halved from four to two in comparison with known arrangements where the reflector is formed from two body members.

In accordance with another aspect of the invention, there is provided a lamp assembly comprising an elongate source of radiation, a reflector with an elongate reflective surface partly surrounding the source and having an opening for emission of radiation down towards a substrate for curing a coating thereon, the reflective surface having a generally concave profile and the source being located near the base of the concavity, wherein the reflector comprises two reflector elements each having a shaped surface which combines with the other when the elements are held in a first relative position to form a cavity in which the source is located and on the surface of which the reflective surface is provided, and wherein the source is mounted such as to be movable with one element to a second position relative the other element in which the source is located in a user accessible position.

This arrangement overcomes the problem found with lamp assemblies that a significant time is required to change the radiation source. By mounting the radiation source such that it is movable with one element of the reflector relative the other into a user accessible position, repairing or replacing the radiation source can be more quickly performed.

Preferably the reflector elements each comprise a body member having at least one passage for cooling water flow and the first and second aspects are combined with the passages in the body members being connected via a tube for cooling water located in the vicinity of the emission opening.

The combination is particularly efficient if the movable body member is pivotable relative the other body member about a pivot axis parallel to the longitudinal axis of the cooling tube. The cooling tube acts in effect as a rotary union and allows access to the radiation source without any potential adverse effect on the integrity of the water seals.

In a still further aspect, the invention provides a lamp assembly comprising an elongate source of radiation, a reflector with an elongate reflective surface partly surrounding the source and having an opening for emission of radiation down towards a substrate for curing a coating therein, the reflective surface having a curved generally concave profile between the edges of the emission opening which is symmetrical about a centerline on which the source is located, wherein the reflector has two elongate radiation diverting surfaces extending down from the edges of the emission opening and arranged to reflect radiation reflected by the reflective surface and divert it toward the centerline, thereby to reduce the angular spread of radiation reaching the substrate.

It has been found that by providing the radiation diverting surfaces extending down from the emission opening, it is possible to focus the radiation into a narrow beam which also has the effect of increasing the intensity of the radiation reaching the substrate. The provision of diverting surfaces is particularly useful when the width of the assembly as a whole has been reduced since, as discussed above, this may otherwise give rise to potential for wide angular spread and the problems which result therefrom.

The diverter surfaces may extend at an angle away from the centreline and may be flat or slightly curved. If so arranged, their primary effect is to turn radiation emitted from the lower sides of the source which would tend to be at a relatively large angle away from the centerline back in towards the centerline and so combine that radiation with the radiation emitted from the top and bottom of the source to give a focused beam of comparatively constant high intensity.

The reflector may comprise a body having a cavity in which the source is located and on the surface of which the reflective surface is provided and the diverter surfaces may be provided on separate end pieces mounted on the body. If the known arrangement whereby the reflective surface comprises at least one plate secured by a clamp on either side of the emission opening is adopted, then the clamps can act as the end pieces. Whatever form the end pieces take, they are suitably made of, or coated with, a reflective material, the first alternative being preferred.

All three aspects may be combined to result in a lamp assembly which can be small but still produce high intensity radiation of low angular spread whilst being water cooled by a single water inlet and water outlet tube. Furthermore the assembly is efficient in use since the radiation source can readily be accessed and so down time when the source needs to be repaired or replaced is minimized.

BRIEF DESCRIPTION OF THE DRAWINGS

The invention will now be further described by way of example with reference to the accompanying drawings in which.

DETAILED DESCRIPTION OF THE PREFERRED EMBODIMENT

Figure 1:
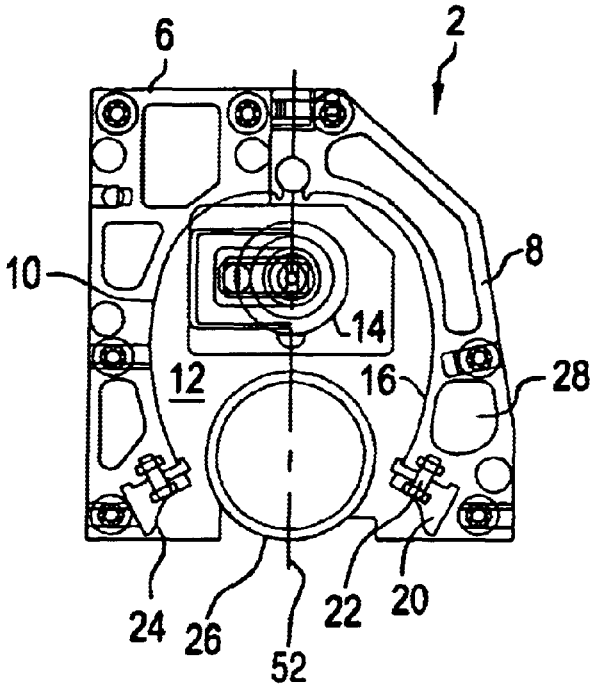
FIG. 1 is an end view of part of a lamp assembly in accordance with the invention in a first, closed position.
Figure 2:
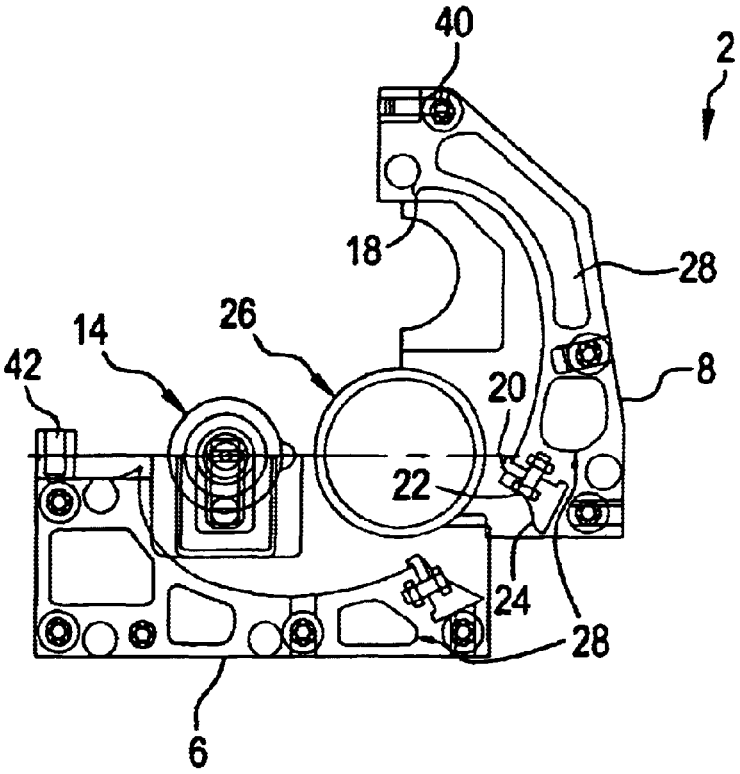
FIG. 2 is an end view of the lamp assembly part of FIG. 1 in a second, open position.
Figure 3:
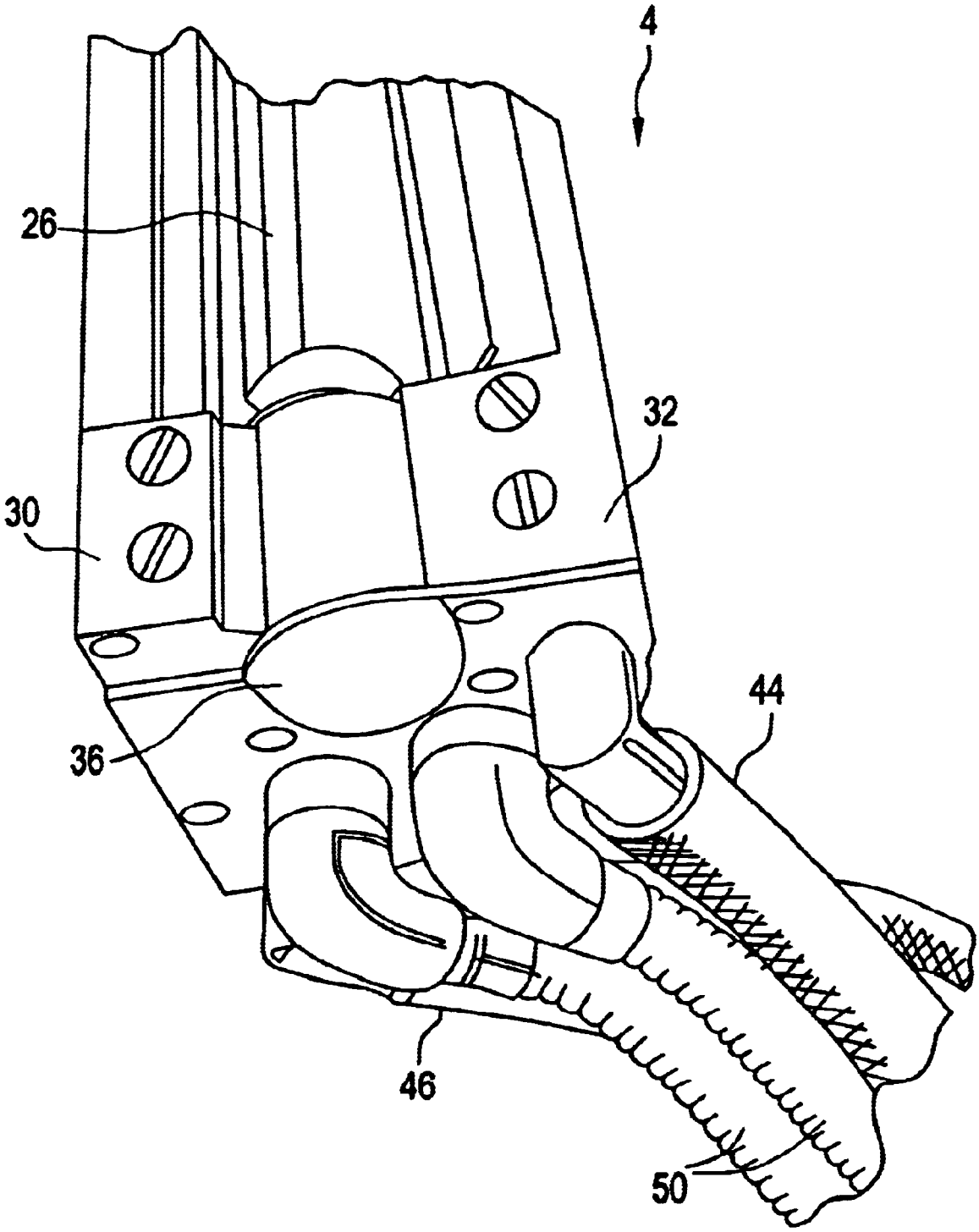
FIG. 3 is a perspective end view of a lamp assembly in accordance with the invention in the first, closed position.
Figure 4:
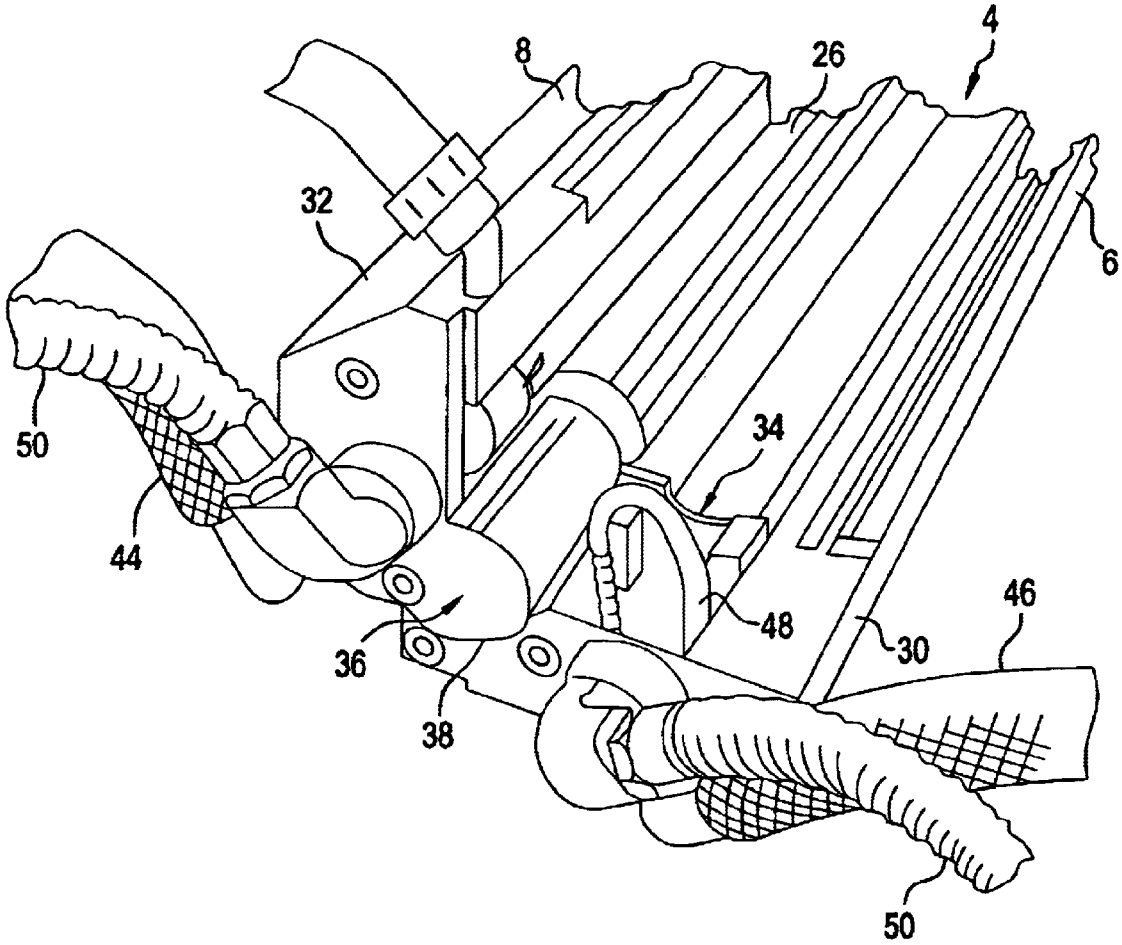
FIG. 4 is a perspective view of the lamp assembly of FIG. 3 in the second, open position.

FIGS. 1 and 2 show a reflector 2 forming part of a lamp assembly 4 illustrated in FIGS. 3 and 4.

The reflector 2 comprises two reflector body members 6, 8 each of which is formed as an extrusion. The extrusions 6, 8 each have a shaped surface 10, the shaped surfaces combining when the extrusions 6, 8 are in a first relative position shown in FIG. 1, to form a cavity 12.

A lamp 14 is mounted in the cavity 12 for emitting radiation down onto a substrate (not shown) passing below the reflector 2 via the cavity opening designed between the bottom edges of the shaped surfaces 10. The substrate may be continuous or comprise multiple sheets that are fed past the lamp in succession and may carry a coating capable of being cured by the radiation from the lamp 12. Radiation emitted from the bottom of the lamp 14 is directly transmitted to the substrate whilst radiation emitted from the sides and top is reflected from a pair of reflector plates 16 mounted to the extrusions 6, 8 against the shaped surfaces 10. The reflector plates 16 may be formed from or coated with a dichroic material. Each is held in place between a flange 18 of the extrusion 6, 8 and a clamp 20 fitted to the extrusion 6, 8 at the lower end of the shaped surface 10 by bolts 22.

The clamps 20 are generally triangular in cross-section and are fitted with the extrusions 6, 8 such that the surfaces 24 which define the hypotenuse of the triangular cross-section extend generally transverse to the adjacent portions of the shaped surfaces 10 of the extrusions 6, 8. The clamp surfaces 24 act to divert radiation received thereon by virtue of formation of the clamps 20 of suitable reflective material such as silver. Alternatively, the clamps 20 can be formed of non-reflective material and the diverter surfaces 24 coated with reflective material.

Between the ends of the shaped surfaces 10, and hence also between the clamps 20, a cooling tube 26 is mounted. The cooling tube 26 is sized and located such that substantially all the radiation emitted by the lamp 14 passes through the tube 26, either directly or following reflection from the reflector plate 16.

The cooling tube 26 is preferably formed of quartz and is fed with de-ionised water. Therefore, in addition to cooling the lamp assembly 4, the cooling tube 26 will act to filter infrared radiation from that emitted by the lamp 14 and also to focus that radiation onto a substrate passing below the reflector 2.

The lamp assembly 4 is also cooled by flow of cooling water through passages 28 formed in the extrusions 6, 8. The passages 28 are shaped such as to surround the cavity 12 and so maximize the dissipation of the heat generated in the cavity 12 by operation of the lamp 14.

The extrusions 6, 8 are formed with end pieces 30, 32 respectively, one of each of which can be seen in FIGS. 3 and 4. At the end of the lamp assembly 4 shown in those Figures, the end piece 30 of extrusion 6 is formed with a lamp mount 34 whilst the end piece 32 of extrusion 8 is formed with a cooling tube mount 36. The ends are handed so that at the opposite end of the lamp assembly 4, the end piece 30 of extrusion 6 is formed with a cooling tube mount 36 whilst the end piece 32 of extrusion 8 is formed with a lamp mount 34.

The cooling tube mounts 36 have a generally circular cross-section and are received in corresponding sized and shaped recesses 38 of the lamp mounts 34. The combination of the mounts 36 and recesses 38 form pivots about which the extrusion 6 can rotate relative the extrusion 8 between the closed position show in FIGS. 1 and 3 and the open position shown in FIGS. 2 and 4. In the closed position of FIGS. 1 and 3 the extrusions 6, 8 are held together by a bolt 40 held captive in extrusion 8 which is engaged in a bolt hole 42 provided in extrusion 6.

In the closed position, as already noted, the shaped surfaces 10 combine to form the cavity 12. In the open position with extrusion 6 rotated relative extrusion 8, the cavity 12 is broken open from above making the lamp 14 accessible and so allowing repair or replacement. Thus, by employing the cooling tube 26 as, in effect, a rotary union, the lamp 14 is made readily accessible, so facilitating servicing and replacement and hence reducing the downtime involved in such servicing and replacement.

The cooling tube 26, by virtue of its mounting, remains stationary when the lamp assembly 4 is moved from the open to the closed position and vice versa. This allows the cooling tube 26 to be used a part of a cooling liquid supply to the passages 28 of the extrusions 6, 8. This, in turn, enables the number of water pipes required for the lamp assembly 14 to be reduced. As shown in FIGS. 3 and 4 the lamp assembly 4 has only two water pipes 44, 46. Cooling water is fed via one of these pipes 44, 46 to one of the extrusions 6 or 8. The water passes along the passages 28 of that extrusion 6 or 8 and thence to the cooling tube 26 via one of the cooling tube mounts 36. The cooling water then passes via the other cooling tube mount 36 to the other extrusion 6 or 8, along the passages of that extrusion and out via the second water pipe 46.

Figure 6:
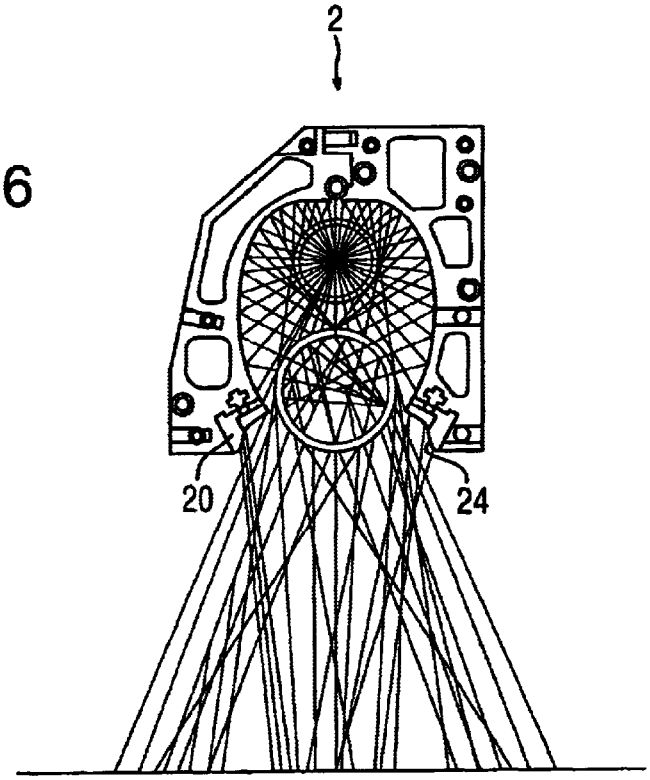
FIG. 6 shows a radiation pattern produced by a lamp assembly in accordance with the invention.

In use with the lamp assembly in the closed position and water supplied via pipes 44,46, the lamp 14 is energized via a lead 48 and a high voltage electric cable 50. A second cable 50 supplies low voltage to a temperature indicator (not shown). Radiation is emitted from the lamp 14 as illustrated in FIG. 6. As that Figure shows nearly all the emitted radiation passes through the cooling tube 26. Furthermore all the radiation that passes through the cooling tube 26 has been reflected at most once only from the reflector plates 16.

Figure 5:
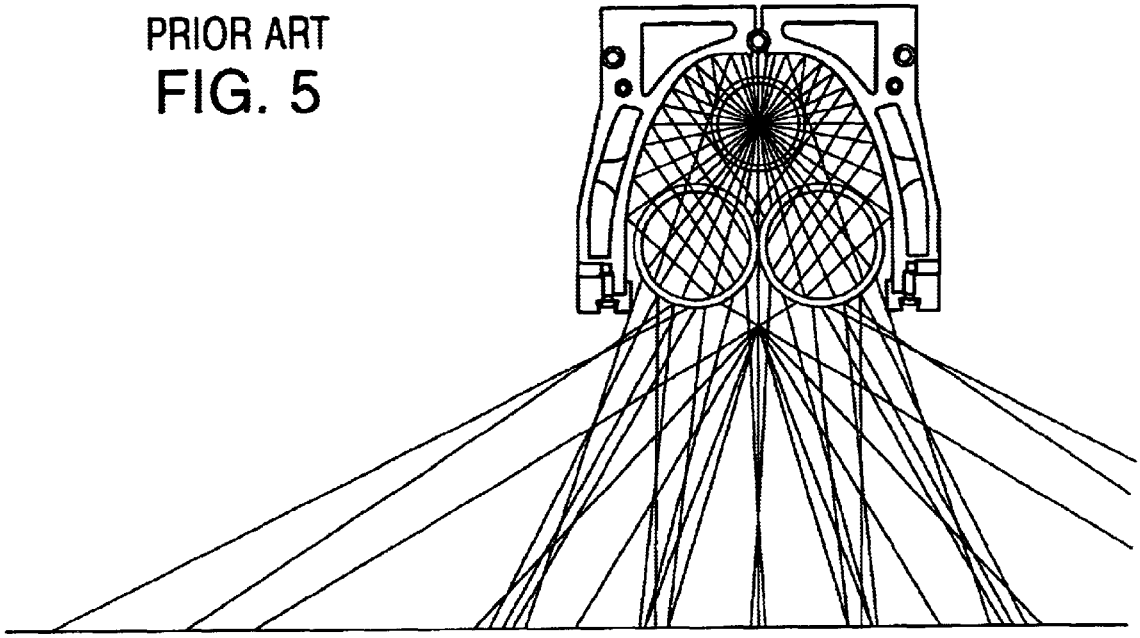
PRIOR ART FIG. 5
FIG. 5 shows a radiation pattern produced with the lamp assembly in accordance with the prior art.

The shaping of the surfaces 10, and hence the cavity 12, is also such that the radiation emitted from the cavity opening has relatively wide angular spread. This is because the cavity 12 is shaped such that it narrows towards the opening which enables the lamp assembly 4 overall to be narrower than known assemblies such as that illustrated in prior art FIG. 5.

The wide angular spread of the radiation is however reduced by the diverter surfaces 24. These act to focus the radiation into a narrower beam by diverting radiation exiting the cooling tube 26 sideways back inwards towards the centerline 52 of the cavity 12, on which the centers of the lamp 14 and cooling tube 26 lie. The focusing of the radiation produced by the diverter surfaces 24 also has the effect of increasing the UV intensity which reaches the substrate.

The lamp assembly 4 has a number of significant advantages. Firstly, it is narrow due to the shape of the cavity 12 which makes it easier to incorporate in a line. This is achieved however, without sacrificing curing efficiency because of the use of the diverter surfaces 24 to focus the emitted radiation into a narrower beam which also results in an increase in the UV intensity reaching the substrate.

In addition, the structure of lamp assembly 4 is simplified in comparison with known lamp assemblies because the number of water pipes is minimized. Operation is also simplified because the lamp can be moved to a user accessible position. These advantages are achieved by feeding the water into one extrusion, through the cooling tube and then into the other extrusion and arranging the water cooling tube to act as a rotary union.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of Applicants' general inventive concept.

What is claimed is:

1. A lamp assembly for irradiating a substrate, comprising:

an elongate radiation source;

a reflector having first and second body members that cooperate to provide an elongate reflective surface partly surrounding said radiation source and an emission opening in said reflective surface positioned to emit radiation from said radiation source toward the substrate, said first and second body members each having a passage for receiving a flow of cooling water; and a tube capable of carrying the flow of cooling water located proximate to said emission opening, said tube coupled in fluid communication with said passage in each of said first and second body members.

2. The lamp assembly of claim 1 wherein said tube is dimensioned and positioned relative to said emission opening such that substantially all radiation from said radiation source is directed toward the substrate through a portion of said tube.

3. The lamp assembly of claim 1 wherein said passages and said tube are coupled in fluid communication such that the cooling water flows into an inlet of said passage of said first body member to said tube and from an outlet of said tube to said passage of said second body member.

4. The lamp assembly of claim 1 wherein said tube has a longitudinal axis and said radiation source is positioned relative to said reflective surface such that radiation reflected to one side of said radiation source crosses radiation reflected from an opposite side of said radiation source above said longitudinal axis of said tube.

5. A lamp assembly for irradiating a substrate, comprising:

an elongate radiation source;

a reflector having first and second body members that cooperate to provide an elongate reflective surface partly surrounding said radiation source and an emission opening in said reflective surface positioned to emit radiation from said radiation source towards the substrate, said radiation source mounted to said first body member, and said first body member movable relative to said second body member between a first position in which radiation from said radiation source is directed by said reflective surface toward said emission opening and a second position, said radiation source being movable with said first body member between said first and second positions to permit user access when said first body member is in said second position.

6. The lamp assembly of claim 4 further comprising a tube capable of carrying a flow of cooling water, said tube located proximate to said emission opening and between said emission opening and said radiation source when said first and second body members are in said first position so that said tube occludes said emission opening.

7. The lamp assembly of claim 5 wherein said tube includes a longitudinal axis and said first body member is adapted for pivotal movement relative to said second body member about a pivot axis parallel to said longitudinal axis of said tube.

8. A lamp assembly for irradiating a substrate, comprising:

an elongate radiation source; and a reflector having an elongate reflective surface partly surrounding said radiation source and an emission opening in said reflective surface positioned to emit radiation from said radiation source towards the substrate, said emission opening surrounded by an edge and said emission opening being symmetrical about a centerline on which said radiation source is located, said reflector further including a radiation diverting surface located proximate to said emission opening and extending outwardly from said edge of said emission opening toward the substrate, and said radiation diverting surface oriented relative to the centerline to reflect radiation reflected by said reflective surface toward the centerline so as to reduce the angular spread of radiation directed toward the substrate.

9. The lamp assembly of claim 8 wherein said radiation diverting surface extends at an angle away from said centerline of said reflector.

10. The lamp assembly of claim 8 wherein said radiation diverting surface has a shape selected from the group consisting of flat and concavely curved.

11. The lamp assembly of claim 8 wherein said reflector further includes an elongate radiation diverter mounted to said reflector, said radiation diverter carrying said radiation diverting surface.

12. The lamp assembly of claim 11 wherein said radiation diverter is formed from a reflective material.

13. The lamp assembly of claim 11 wherein said radiation diverting surface of said radiation diverter is coated with a reflective material.

14. The lamp assembly of claim 11 wherein said reflector includes body member and a reflector plate having opposite ends, said reflector plate carrying said reflector surface and said radiation diverter securing one of said opposite ends of said reflector plate to said member.

* * * * *